US009761211B2

(12) United States Patent
Redding et al.

(10) Patent No.: US 9,761,211 B2
(45) Date of Patent: Sep. 12, 2017

(54) DETACHABLE CONTROLLER DEVICE FOR MUSICAL INSTRUMENTS

(71) Applicant: Viditar, Inc., Austin, TX (US)

(72) Inventors: Travis Ray Redding, Austin, TX (US); Jason William Smith, Austin, TX (US)

(73) Assignee: Viditar, Inc., Austin, TX (US)

( * ) Notice: Subject to any disclaimer, the term of this patent is extended or adjusted under 35 U.S.C. 154(b) by 0 days.

(21) Appl. No.: 14/455,527

(22) Filed: Aug. 8, 2014

(65) Prior Publication Data

US 2015/0040744 A1 Feb. 12, 2015

Related U.S. Application Data

(60) Provisional application No. 61/958,895, filed on Aug. 9, 2013.

(51) Int. Cl.

| | |
|---|---|
| ***G10H 3/18*** | (2006.01) |
| ***G10H 1/00*** | (2006.01) |
| ***G10H 1/32*** | (2006.01) |

(52) U.S. Cl.

CPC ..... *G10H 3/18* (2013.01); *G10H 1/0066* (2013.01); *G10H 1/32* (2013.01); *G10H 3/186* (2013.01); *G10H 2220/391* (2013.01)

(58) Field of Classification Search

CPC ..... G10H 2220/401; G10H 1/342; G10H 2220/201; G10H 2220/391; G10H 2220/395

USPC ..... 84/726

See application file for complete search history.

(56) References Cited

U.S. PATENT DOCUMENTS

| | | | | |
|---|---|---|---|---|
| 5,105,711 | A * | 4/1992 | Barnard | 84/744 |
| 5,245,128 | A * | 9/1993 | Araiza | 84/626 |
| 5,633,474 | A * | 5/1997 | Cardey, III | 84/663 |
| 7,339,107 | B2 * | 3/2008 | Remignanti | 84/737 |
| 7,501,571 | B2 * | 3/2009 | Forsman et al. | 84/737 |
| 7,667,128 | B2 * | 2/2010 | Hosler | 84/723 |
| 7,667,129 | B2 * | 2/2010 | Chidlaw et al. | 84/723 |
| 7,982,124 | B1 * | 7/2011 | Landis et al. | 84/727 |
| 8,283,547 | B2 * | 10/2012 | Villa et al. | 84/609 |
| 8,455,749 | B1 * | 6/2013 | Gage et al. | 84/730 |
| 8,796,529 | B2 * | 8/2014 | Butera et al. | 84/722 |
| 8,865,992 | B2 * | 10/2014 | Shavit | G10H 1/055 84/615 |
| 9,286,872 | B2 * | 3/2016 | Packouz | G10H 3/186 |
| 2003/0041721 | A1 * | 3/2003 | Nishitani et al. | 84/609 |
| 2003/0196542 | A1 * | 10/2003 | Harrison, Jr. | 84/737 |
| 2006/0243123 | A1 * | 11/2006 | Ierymenko | G10H 3/125 84/742 |
| 2006/0272489 | A1 * | 12/2006 | Remignanti | 84/723 |
| 2008/0173162 | A1 * | 7/2008 | Williams | 84/645 |
| 2013/0263721 | A1 * | 10/2013 | Shavit | G10H 1/055 84/626 |

* cited by examiner

*Primary Examiner* — Jeffrey Donels

(74) *Attorney, Agent, or Firm* — Rothwell, Figg, Ernst & Manbeck, PC

(57) ABSTRACT

A device that can be temporarily attached to a musical instrument and easily detached without permanent modification to the instrument. The device is comprised of a set of controls attached to circuitry that is used to send digital data to a computer or other hardware to be used for music synthesis, manipulation, or production.

15 Claims, 6 Drawing Sheets

DETACHABLE CONTROLLER DEVICE FOR MUSICAL INSTRUMENTS

CROSS-REFERENCE TO RELATED APPLICATIONS

The present application claims priority benefit under 35 U.S.C. §119(e) of U.S. Provisional Patent Application No. 61/958,895, entitled "Detachable Digital Music Controller Device for Musical Instruments," filed Aug. 9, 2013, the contents of which are incorporated herein by reference in their entirety.

TECHNICAL FIELD

The present invention relates generally to enhancing the functions of musical instruments and, more particularly, to devices that attach to musical instruments for enhancing and controlling the functionality of the musical instruments and to methods providing for operation of such devices.

BACKGROUND

Devices for the generation of sound have been in use for thousands of years and come in many styles and forms. More particularly, devices and instruments for the generation of sound that may be pleasing to the ear in what is termed music have been under development and use for many centuries. The guitar is one such musical instrument; and, while much of this disclosure discusses the guitar as an exemplary musical instrument, the invention discussed here is not limited to the guitar and can, in fact, be applied to many musical instruments, including other string instruments, percussion instruments, and wind instruments, for example and not limitation.

The development of the guitar has evolved over hundreds of years. Relatively recent advancements across the past few decades include incorporating electronic pickups into the guitar and connecting the guitar to an amplifier for enhanced and distributed playback of the music while the guitar is being strummed, plucked, struck, or otherwise played. This progress continued in various forms until the 1980's, when there became a desire to connect the instrument to digital computer systems for further enhanced playback and recording. This digital connection has been traditionally made using a common musical digital language known as Musical Instrument Digital Interface, abbreviated as "MIDI."

MIDI is a music industry protocol standard used to communicate digital data between hardware devices and computers. The past few decades have seen many attempts to add MIDI control to guitars and other musical instruments. In the recent decade, digital music data communication has expanded from the MIDI protocol to similar systems such as Open Sound Control ("OSC") protocol and proprietary serial data. Providing such protocol to music output from an instrument usually requires building digital control circuitry into the instrument. This is accomplished by either building a dedicated music instrument for digital control or permanently modifying an existing music instrument. These specialized builds commonly compromise the sound, function, and price of the instrument.

Historically, for an existing analog musical instrument to send signals conforming to the MIDI protocol, the instrument has to be permanently modified, either with a traditional MIDI pickup that converts string movement to MIDI signals or with digital controls and circuitry being built into the instrument. Including or adding the digital controls to the instruments often means that the instrument must be permanently modified by cutting or drilling to accommodate the controls and companion circuitry for the controls. These required modifications for a stringed instrument (or percussion or wind, for example) are both costly and leave the instrument as a dedicated digital instrument for digital play and playback, while leaving the instrument less desirable as a traditional analog instrument.

SUMMARY

According to certain embodiments, there is provided a detachable device for control of a musical instrument, including a housing attached to a musical instrument, the housing providing for a set of controls and circuitry, wherein the housing is attached without modifying the musical instrument and wherein the housing is attached without compromising the operation of the musical instrument; one or more user-operated controls contained in the housing, wherein the controls modify the play of music from the musical instrument; one or more sensors detecting orientation of the musical instrument; one or more sensors detecting movement of the musical instrument; and a clamp attaching the housing to the musical instruments, wherein the device can be detached from the musical instrument.

Certain embodiments further provide that the play of music is controlled based on the orientation of the instrument and that the play of music is controlled based on the motion of the instrument. Additional embodiments provide for the housing being attached to the instrument without modification of the musical instrument and the housing being removable from the instrument without tools.

According to particular embodiments, there is a method for controlling the play of music with a controller device attached to a musical instrument, including holding and playing a musical instrument, wherein a controller device is attached to the musical instrument; changing the orientation of the musical instrument, wherein the controller device detects the change in orientation of the musical instrument; generating, by the controller device, output control signals based on the detected change in orientation of the musical instrument; and controlling the play of music from the musical instrument based on the generated output control signals.

Particular embodiments further provide for controlling the generation of sound by the instrument based on changes in the orientation of the instrument.

Additional embodiments also provide for increasing the sound volume of the play of music as the pitch of the musical instrument is raised upward and decreasing the sound volume of the play of music as the pitch of the musical instrument is lowered downward.

In certain embodiments there is provided a method for controlling play of sound, including holding and playing a musical instrument, wherein a controller device is removably attached to the musical instrument; generating audio output signals from the instrument as the user is playing the instrument; manipulating controls on the controller device; generating, by the controller device, output control signals based on the user manipulation of the controls on the controller device; and controlling the play of sound from the musical instrument based on the generated output control signals.

Additional embodiments also provide for the output control signals controlling one or more of lighting, sound, playback, special effects, sound recording, and display.

In accordance with certain embodiments, there is provided a musical instrument control system, including a detachable controller attached to a musical instrument; one or more controls located on the detachable controller transmitting digital control signals upon manipulation by a user of the musical instrument; a computer receiving the transmitted digital control signals and processing the control signals into control messages; and equipment hardware receiving the control messages and controlling an equipment hardware function based on the control messages.

Particular embodiments further provide the equipment hardware function comprising one or more of lighting control, sound control, special effects control, sound recording control, and display control.

BRIEF DESCRIPTION OF THE DRAWINGS

The accompanying drawings, which are incorporated herein and form part of the specification, illustrate various embodiments of the present disclosure and, together with the description, further serve to explain the principles of the disclosure and to enable a person skilled in the pertinent art to make and use the embodiments disclosed herein. In the drawings, like reference numbers indicate identical or functionally similar elements.

DETAILED DESCRIPTION

Particular embodiments are directed to devices and methods for enhancing and controlling the functionality of musical instruments and the play of sound therefrom. This invention provides devices and methods for musicians playing an instrument such as a guitar to be able to control digital devices from the guitar itself without permanently modifying the traditional form of the guitar and to control effects related to the play of musical instruments.

In the following description, numerous specific details are presented. However, it is understood that embodiments of the invention may be practiced without these specific details. In other instances, well-known devices, structures, and methods have not been shown in detail in order to not obscure the understanding of this description. It will be appreciated, however, by one skilled in the art, that the invention may be practiced without such specific details. Those of ordinary skill in the art, with the included descriptions, will be able to implement appropriate functionality without undue experimentation.

While the invention will be described in connection with its preferred embodiments, including control based on the play of a guitar, it will be understood that the invention is not limited thereto. On the contrary, it is intended to cover all alternatives, modifications, and equivalents, which may be included within the spirit and scope of the invention, as defined by the appended claims. For example, exemplary embodiments can be applied to percussion instruments such as drums and cymbals and can be applied to wind instruments such as trumpets and saxophones.

Figure 1:
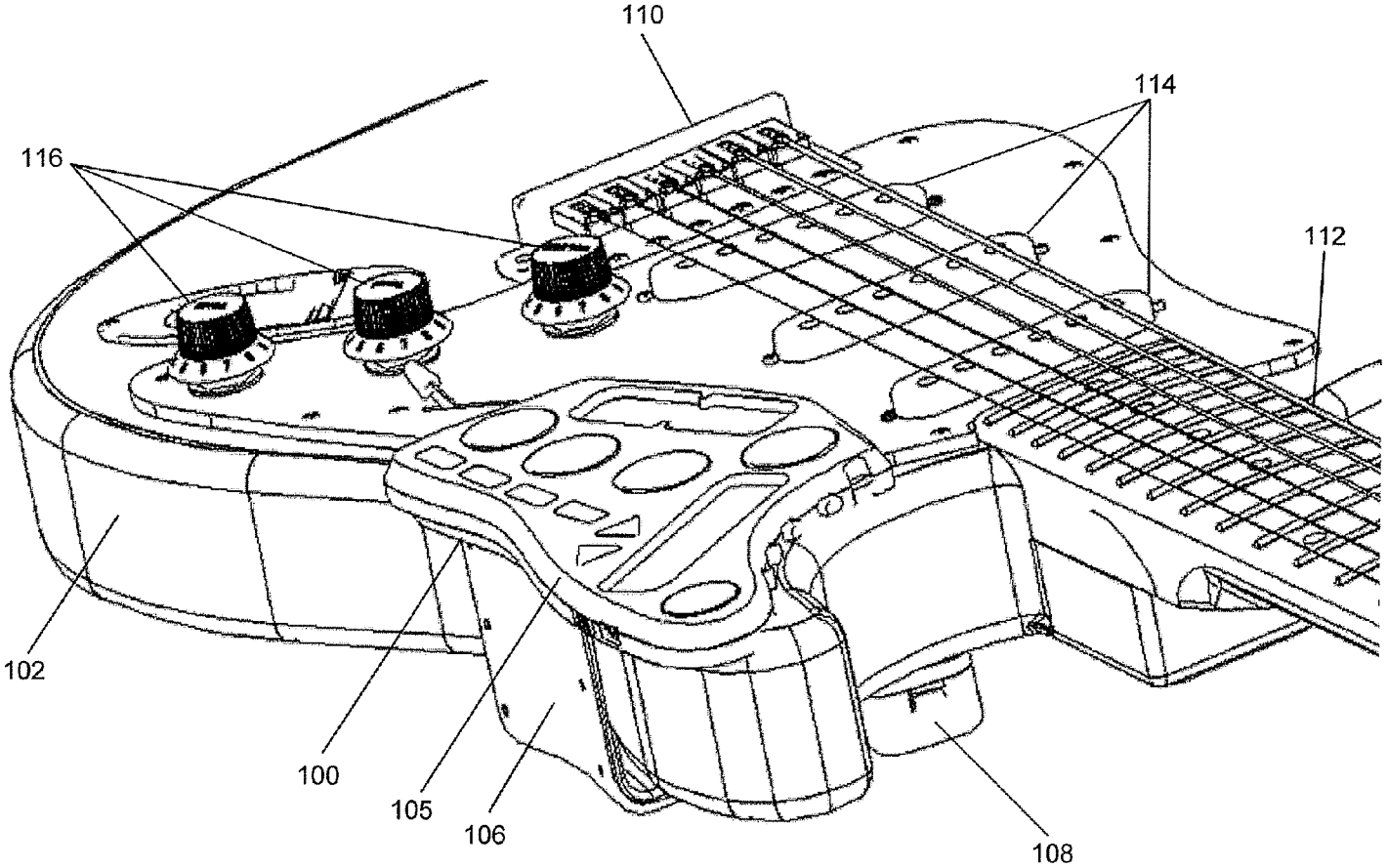
FIG. 1 illustrates an embodiment of a detachable controller device attached to an electric guitar as an exemplary musical instrument.

Referring first to FIG. 1, there is shown an exemplary application of a controller device 104 attached to the body 102 of an electric guitar 100. While a guitar 100 is shown as the exemplary musical instrument whose playback of sound can be controlled with the device 104, many other instruments and devices can be controlled by exemplary embodiments. For example and not limitation, a similar controller device 104 can be attached to a violin, a banjo, or a cello. Similarly, the controller device 104 can be configured to interface with the output from percussion and wind instruments to also serve to control the play and playback of sound generated by those musical instruments.

The controller device 104 can be attached to a musical instrument, such as a guitar 100, and can be easily detached, i.e., removed, without permanent modification to the instrument. The device 104 is comprised of a set of controls with circuitry that is used to send digital signals to a computer or other hardware. By attaching to an instrument that otherwise would have no ability to transmit digital signals, this device 104 and methods can be used for music synthesis, special effects, vocal effects, software control of equipment, video and light manipulation, recording or loopback effectsor production from onboard the instrument itself. The player of the instrument, or the user, operates the instrument of the present invention by manipulating any number of possible controls on the device 104, including switches, knobs, buttons, dials, faders, and touch surfaces. Additionally, the device 104 comprises sensors in the form of one or more accelerometers, gyroscopes, and magnetometers. The signals from the controls and sensors are transmitted as digital messages and sent either wirelessly or over a cable to any equipment or processor that can process the transmitted digital signals to control equipment, sound, light, and special effects, for example and not limitation.

The bridge 110 of the guitar serves as an anchor point for the strings 112, which the player or user vibrates, strums, or plucks to generate sound (preferably music) from the guitar 100. The analog pickups 114 are electronic coils used to detect string vibration and generate sound through an electronic signal. Volume/tone controls 116 are used to control the sound and intensity of the analog pickups 114.

The controller device 104 is shown in FIG. 1 as clamped to the guitar 100 with an arm 106 and shoe 108 of a clamp attaching and affixing the controller device 104 to the guitar 100. The device 104 must be easily attachable and detachable but still have enough clamping strength to stay on the instrument where intended. In this manner, the device 104 can be attached and detached without tools or permanently modifying the instrument 100. Accordingly, the clamp may be spring-loaded; and the shoe 108 may have a soft face for contacting the guitar body 102 to permit both ease of attachment and detachment and to avoid or at least minimize any damage to or scratching of the guitar body 102.

Figure 2A:
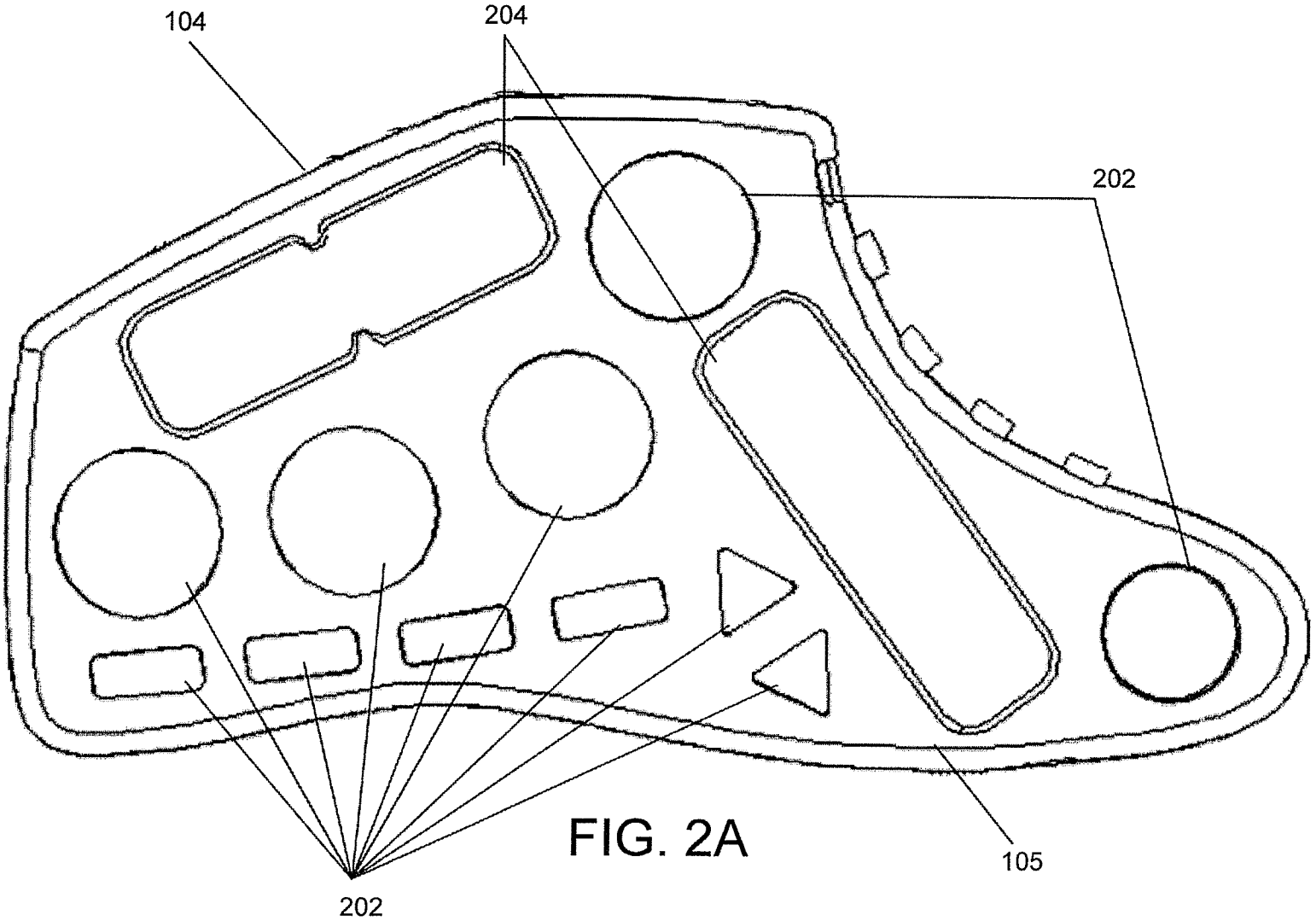
FIG. 2A illustrates a top view of the detachable controller device, in accordance with exemplary embodiments of the present invention.

FIG. 2A shows a top view and controls 202 and 204 of the controller device 104. Referring to both FIG. 1 and also now to FIG. 2A, there is shown the body or housing 105 of the controller device 104 as the main structure that holds all the different components and functional parts of the device 104. The housing 105 should be both durable and low profile for playable addition to an instrument, such as the guitar 100. The device body 105 can come in many shapes, sizes, and colors to conform to the musical instrument 100 to which it is attached and to accommodate the preferences of the user. Similarly, the housing 105 can be made of a number of materials, such as wood, plastic, metal, or rubber. The shape of the device housing 105 is adaptable to variable instrument body designs. Preferably, the housing 105 is designed to fit the shape of unused space of the musical instrument. As utilized herein the user is the individual playing the instrument.

The buttons 202 are used for on/off or pressure sensitive inputs. The user presses or taps the buttons 202 to trigger a digital event. The buttons 202 can be mechanical or membrane switches, force sensing resistors, carbon activated PCB contacts, or any other method of registering a press or touch. The slide controls 204 permit the user to create a linear variable value digital input. Commonly referred to as faders, these components are potentiometers and can be mechanical or touch faders. The user can effect direct digital control of media play without strumming or traditionally playing the instrument through manipulation of the controls 202 and 204 on the device 104 (such as, for example, buttons, switches, slide controls, potentiometers, faders, and variable dials and knobs) and through the sensors in and on the device 104. These controls 202 and 204 are all assignable in software to provide any function necessary or desired by the user for controlling computer-based parameters for the play of music and the control of equipment. Optionally, the housing 105 can include a display, including a touch screen display, for the user to enter commands and receive information about the settings and operation of the musical instrument control system.

The detachable music controller device 104 is self-contained within a housing 105 and can be attached to a musical instrument 100 using several methods without modifying the instrument 100. Through such a flexible design, a user can easily attach the controller device 104 to a musical instrument and thereby quickly, easily, and affordably add digital functionality to his or her instruments. Additionally, an easily detachable music controller device 104 allows the technology to be removed from the musical instrument without modifying or compromising the integrity or operation of the instrument, thereby leaving the instrument in the same condition as it was before the device 104 was added.

Figure 2B:
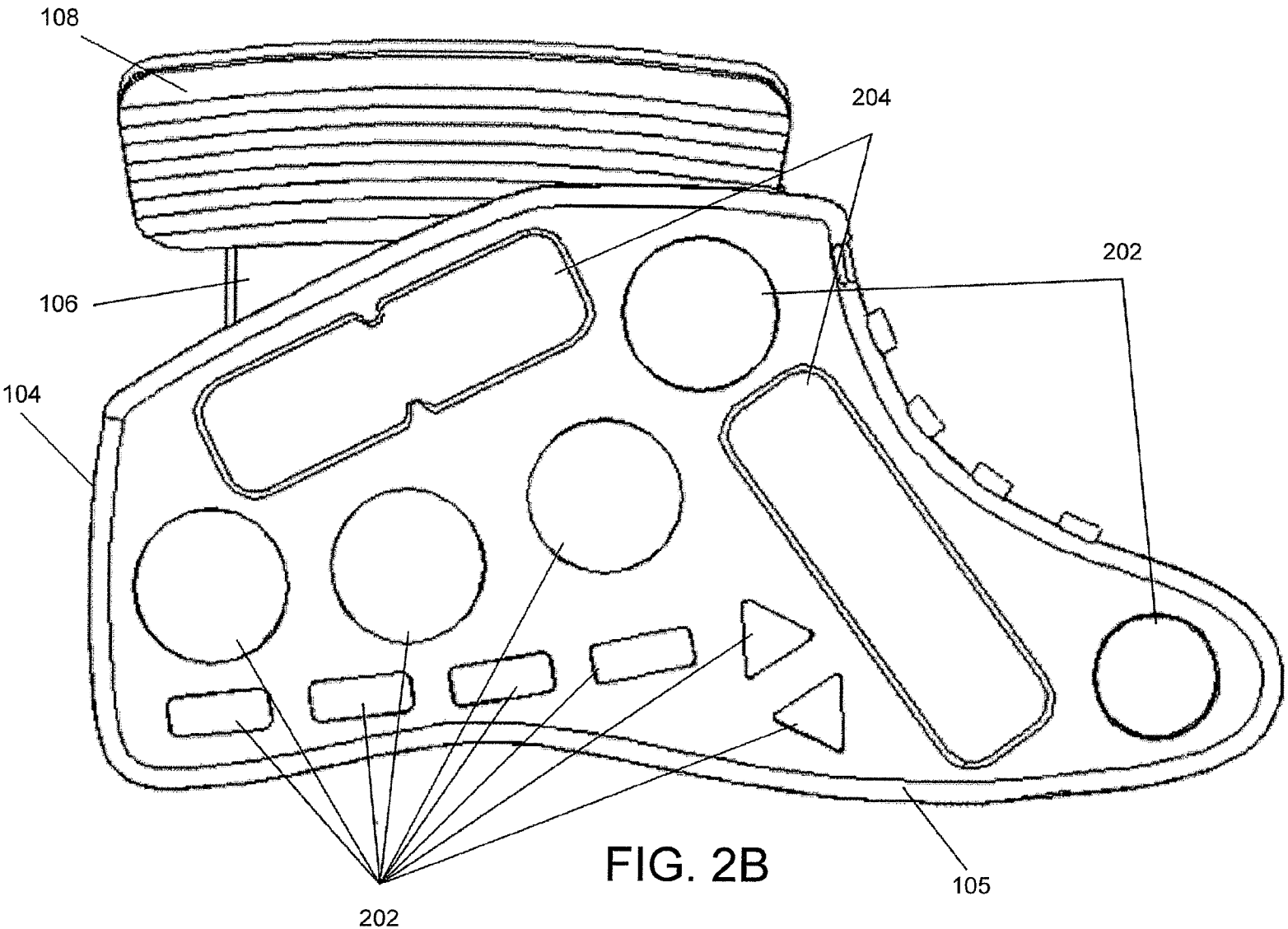
FIG. 2B illustrates a top view of the detachable controller device showing an exemplary clamp that would attach the device to a musical instrument such as a guitar, in accordance with exemplary embodiments of the present invention.
Figure 3:
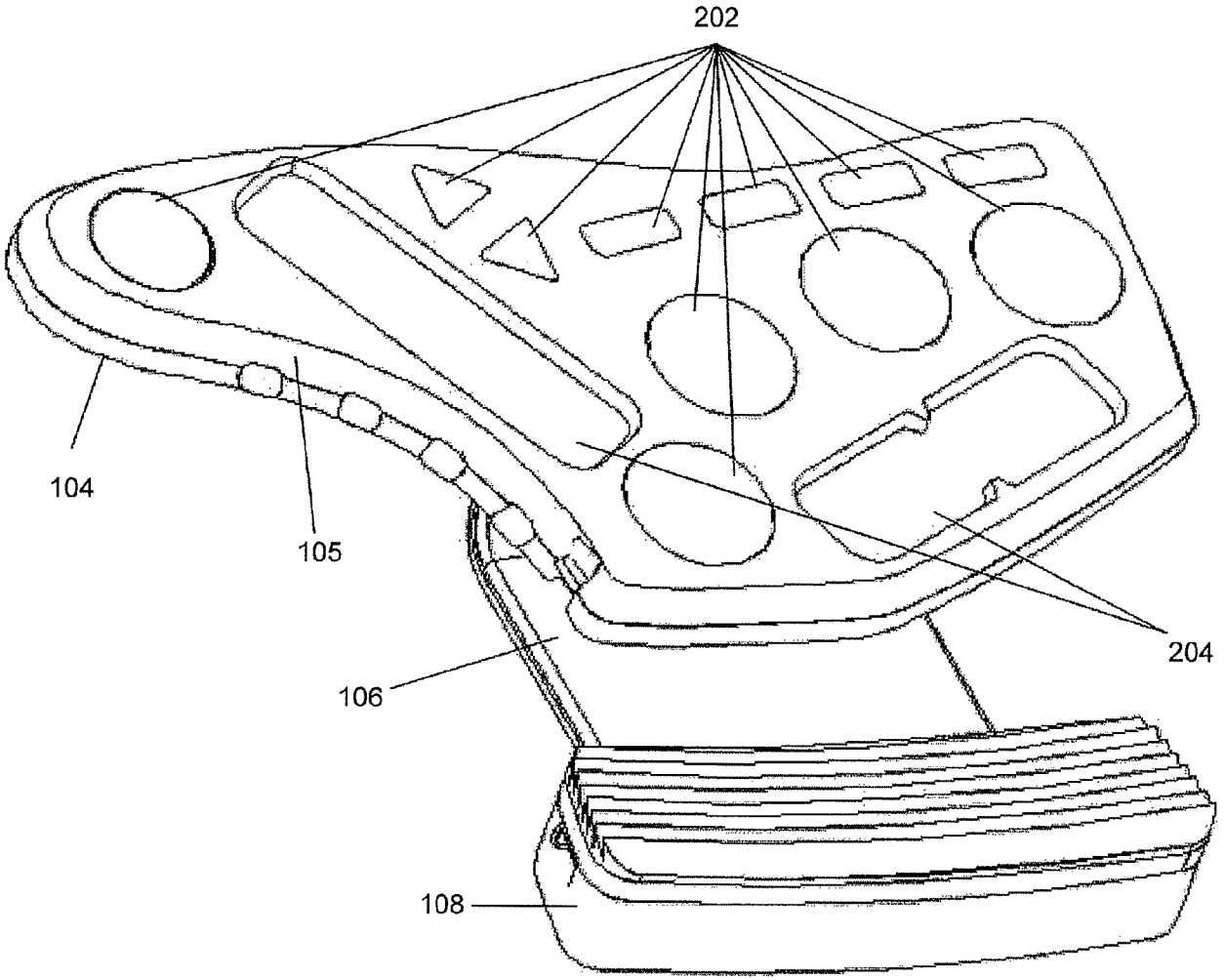
FIG. 3 illustrates a angular view of the detachable controller device showing an exemplary clamp that would attach the device to a musical instrument such as a guitar, in accordance with exemplary embodiments of the present invention.
Figure 4:
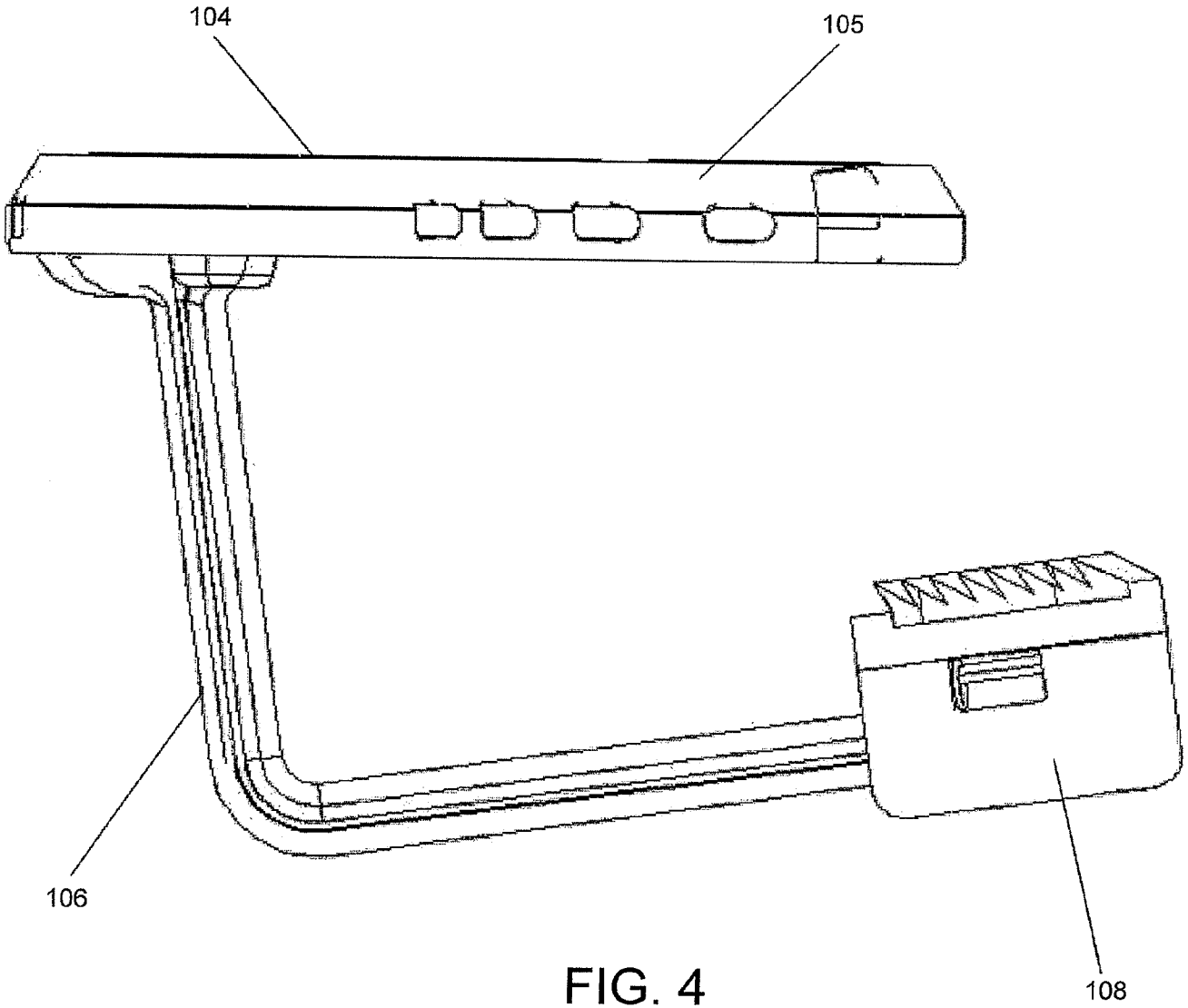
FIG. 4 illustrates a side view of the detachable controller device showing an exemplary clamp that would attach the device to a musical instrument such as a guitar, in accordance with exemplary embodiments of the present invention.

Referring now to FIGS. 2B, 3, and 4, there is shown additional views of the controller device 104, with the inclusion of the arm 106 and shoe 108 of a clamping device for attaching or affixing the controller device 104 to the musical instrument, such as the guitar 100 shown in FIG. 1. The clamping device fits over the instrument body 102 and provides the pressure needed to keep the device 104 attached to the instrument body 102 when in use. The clamp can be made to be adjustable for many different applications. As discussed above, the arm 106 can be spring-loaded, and the shoe 108 can have a soft or non-mar surface for firmly attaching the device 104 to the instrument, but yet permitting ease of attachment and detachment while avoiding modification, damage, or scratches to the instrument itself. While these figures shown an exemplary design for removably attaching the device 104 to the instrument 100, other techniques can be utilized to firmly place the device 104 on the instrument 100 for easy access and control by the user. For example, the device 104 could be affixed to the instrument 100 with a suction cup, adhesive, double-backed tape, or a hook and loop fastener such as a Velcro® product. Also, the instrument itself could be configured with a bracket or mounting system providing ease of attachment for a controller device 104 with a comparable matching bracket or mounting system so as to permit easy mating of the instrument 100 and the device 104. Because of the self-contained design of the controller device 104, the device 104 is not required to be located on a specific part of the instrument and is designed to fit multiple locations on the instrument.

The device 104 includes a control surface on the top of the housing 105 that comprises one or more buttons, switches, slide controls, potentiometers, faders, dials, and knobs 202 and 204, not all of which are shown in FIG. 1. Within the housing are electric pickups and sensors, such as two- and three-axis accelerometers, gyroscopes, and magnetometers. The control surface, pickups, and sensors are part of an assembly that is attached to digital circuitry within the device 104 that processes and converts the response or signals from the control surface components into MIDI, OSC, Human Interface Device ("HID"), or other serial data protocols and outputs a digital signal from the controller device 104. The detachable controller device transmits the data signals, preferably wirelessly, to a computer or other hardware, which receives the data as a control input.

The device is powered by either a battery or a plug-in power source, either separately or through the instrument to which it is attached. All circuitry, controls, and power source are contained in the housing 105. While not required, the housing 105 is preferably in a shape that fits the curves of the instrument on which it is placed, as shown in FIG. 1. The device housing 105 is sufficiently thin to not interfere with the playing area of the instrument but is substantial enough and close enough to the traditional playing areas that it is quickly accessible by the user utilizing slightly modified strumming and playing methods. FIG. 1 shows the placement of the device 104 in close proximity to where the user traditionally plays the instrument 100 and where typical user hand positions are for that particular instrument.

To operate the controller device 104, the user will attach the device 104 to the instrument 100 in the desired position. See FIG. 1. In this example, the device's lower clamp arm 106 is slid over the lower horn of the guitar 100. Care is taken to make sure the device 104 does not interfere with existing instrument controls, such as volume/tone controls 116. Once the device 104 is attached, it is then powered up. The power-up process can be initiated by the user activating a switch on the device 104, or can be automatically activated with the powering-up of the instrument 100.

Figure 5:
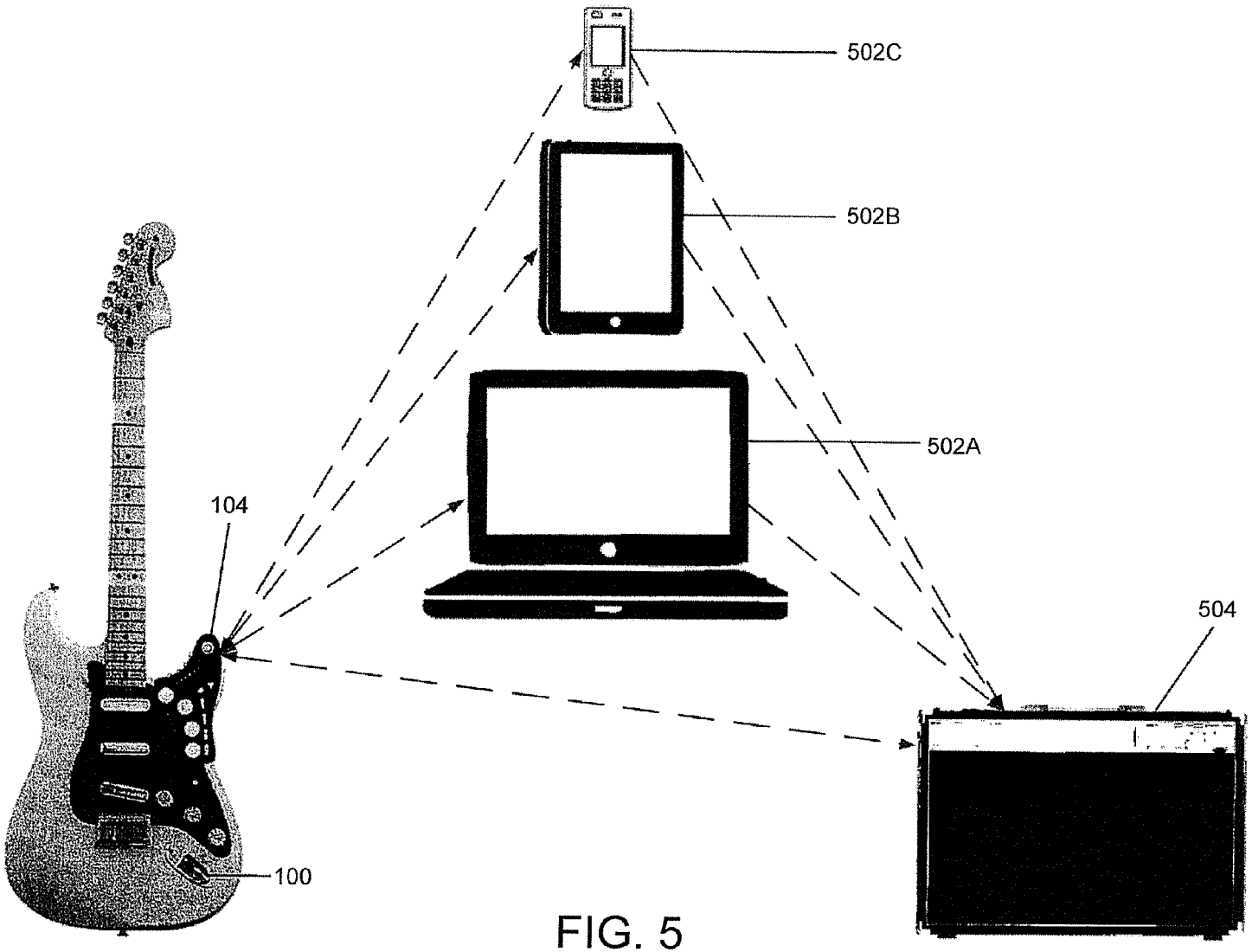
FIG. 5 illustrates a system utilizing the detachable controller device communicating with components of a music control/play system.

Referring now to FIG. 5, there is shown a musical instrument control system, whereby the controller device 104 on the instrument 100 communicates with one or more computers to control play or playback of the music from the instrument 100. The personal computer 502A, the tablet 502B, and the smart cellular phone 502C are representative of the computers with which the controller device 104 can communicate and send signals. Each of these computers 502A-502C can in turn communicate (via the dotted lines shown in the figure) with other devices for the ultimate control and/or playback. For example, an amplifier 504 is shown, whereby the control signals are transmitted from the control device 104 to a computer 502A, for example. The computer processes the signals and in turn sends control and command signals to the amplifier 504, which controls music output from the speakers connected to it. In one embodiment, the device 504 controls lighting, and the signals from the control device 104 can control the lighting being used during a musical performance. In yet another embodiment, the control device 104 can communicate directly with the device 504 without the intermediate processing by the computer 502A-502C. The hardware device 504 is envisioned to be one of many computer-controlled devices that can be controlled through the user-manipulated controls on the controller device 104 and the output signals from the sensors of the controller device 104. For example, and not limitation, the equipment hardware device 504 can control such functions as lighting, sound, music playback, special effects, recording, and displays of information and images.

The communication of signals among the components of the musical instrument control system of FIG. 5 is preferably wirelessly, such as through Bluetooth protocols, radio frequency, or a wireless network, including communication of signals between the instrument, such as the electric guitar 100 of FIG. 1, and the controller device 104. Alternately, some or all of the components can be wired together. While the musical instrument control system of FIG. 5 is typically confined to a single room or space, the inventive concepts of the system and the control device 104 are not so limited; and instruments can be controlled and music play can be controlled through a network where the components are out of a line of sight.

Through known communication signaling and handshaking protocols, all input connections are made; and the device 104 is connected to one or more of the exemplary computers 502A-502C or other type of digital receiver and to equipment hardware 504. The device 104 can include one or more processors, firmware, and memory, some of which is reserved as computer-readable, non-transient memory for storing software instructions that can control the operation of the controller device 104. The software instructions, when executed by the computer and/or the processor can provide for the control and play of music as discussed herein. The controller device 104 is further configured with an antenna or other wired or wireless connection device coupled to the processor for receiving and transmitting information, signals, and messages.

The device 104 sends and receives digital signals. In particular, the device 104 contains analog and/or digital controls that are converted to digital data in the form of MIDI, OSC, HID, or other digital serial data protocols and sent wirelessly to a computer 502A-502C or other hardware device 504. To send signals, the user manipulates the input controls 202 and 204 by pressing buttons and switches, reacting with sensors, turning potentiometers, or moving the instrument in space to be detected by one or more accelerometers, gyroscopes, or magnetometers. As the controls are manipulated, the device sends signals to its receiving computer 502A, tablet 502B, phone 502C, or other smart device. The received signal can then be used to control computer software and manipulate sound, such as with sound production software on the computer 502A-502C or the hardware device 504. The device 104 can also receive signals for visual feedback to on-board indicators such as LED's, LCD screens, or other visual display and for setting parameters for the device 104 itself.

In addition to transmitting its own signals, the device 104 can be configured to process analog signals from the instrument 100 itself. Using an electric guitar 100, for example, the analog output from the electric pickups 114 could be communicated to the device 104. The user would be able to modify the sound generated from the analog electric guitar 100 through manipulation of the control components 202 and 204 and process the sound into a transmitted digital signal to be used by a computer 502A-502C or other digital processing equipment 504. The device 104 can also incorporate a headphone or speaker monitoring system so that the user can hear the output of the instrument 100 in a self-contained on-board solution.

Typical user setups and use of the controller device 104 and musical instrument control system can involve one or more of a wireless peripheral device, such as a smart phone 502C, a wireless host device, such as a personal computer 502A, an instrument, such as a guitar 100, a pre-amplifier, an effects processor (or recording unit), an effects modulation device, an amplifier, such as the equipment hardware 504, and a speaker. In the embodiments discussed below, the software and components of the controller device 104 are capable of performing the functions of one or more of the wireless peripheral device, pre-amplifier, effects processor, effects modulation device, and amplifier.

One of the simplest setups and use of the controller device 104 involves control of the analog audio signal generated by the musical instrument 100. In a typical use and play of a musical instrument, the analog audio signal generated by the instruments is passed wirelessly or by a hard connection to a pre-amplifier. The pre-amplifier increases the power of the audio signal and passes the signal to an effects processor (recording unit). The effects modulation device, while not processing the audio signal directly, can control and provide parameters to the effects processor, thereby controlling how the effects processor modifies the audio signal. The output of the effects processor is passed to an amplifier, which in turn increases the power of the audio signal and passes the resulting signal to a speaker for audio play. As will be explained below, the controller device 104 can take on or control the function of any of the above devices. In other words, the function of one or more of these devices can be integrated into the controller device 104.

The controller device 104 and musical instrument control system also use digital signals for control of operations of the devices. A digital change control signal is transmitted by the effects modulation device and is received by the effects processor. The effects processor, as controlled by the change control signal, performs one or more of (1) modifying the state of the audio signal from the musical instrument, (2) recording part of the audio signal stream, and (3) outputting pre-recorded samples of an audio signal. The change control signal can also be received by the control device 104 to report or display the current settings of the effects modulation device to the user.

The change control signal initiated by the effects modulation device can be transmitted through a wireless peripheral device 502B or 502C to a wireless host device 502A or 502B to the effects processor. While each of these devices can be separate with hard-wired, networked, Bluetooth, or Wifi communication capability, the present embodiment provides for the functionality of one or more of these devices to be contained within the controller device 104, wherein the user can set control parameters through input controls or a display on the controller device 104 or provide the control parameters to the device 104 via an intelligent device such as a smart phone 502C, tablet 502B, or computer 502A.

A digital control feedback signal is transmitted by the effects processor and is received by the effects modulation device. This signal is used to change the state of the effects modulation device to indicate the state of the effects processor to the user in real time through the display on the controller device 104. The control feedback signal can be sent through one or more of a wireless host device 502A or 502B and a wireless peripheral device 502B or 502C and alternate communication paths, especially when one or more of these devices is not integrated into the controller device 104.

User setups for the musical instrument control system can fall into several categories. Within each of these categories, the controller device 104 can include one port for charging its battery. Under a Control-Streaming Only configuration, the controller device 104 will include the functionality of the wireless peripheral device and the effects modulation device. Under this configuration, the controller device 104 is designed to interface with a wide variety of existing software and hardware products using standard communications protocols and connections. The controller device 104 transmits its output control signals separately from the audio output from the instrument 100, and the output control signals control peripheral hardware, such as amplifiers, speakers, lighting, and the like without consideration of the particular audio signals being generated by the musical instrument 100.

Under an Audio and Control Streaming configuration, the controller device 104 will include the functionality of the wireless peripheral device, the effects modulation device, the pre-amplifier, and the effects processor. Both the audio signals generated by the musical instrument 100 and the control signals transmitted by the controller device 104 can be streamed via a hard-wired or wireless connection directly to a Bluetooth host device, such as a powered Bluetooth speaker, Bluetooth headphones, a smart phone 502C, a computer 502A, or a USB Dongle to be played, recorded, monitored, amplified, or further processed, with the recording and processing controlled or modified based on the transmitted control signals. In this configuration, the controller device 104 can use one port to connect the audio signal generated by the musical instrument 100 with an internal pre-amplifier to boost the audio signal prior to transmission.

Under a Stand-Alone Audio and Control Streaming configuration, the controller device 104 will include the functionality of the wireless peripheral device, the pre-amplifier, the effects processor, the effects modulation device, and an amplifier comprising a wired headphones jack. In this embodiment, the user can listen to the generated music in real time through headphones as the music is controlled and modified by the settings and operation of the controller device 104. This embodiment provides for user stand-alone sampling of the music being generated by the instrument 100 and controlled and modified by the controller device 104, without any need for additional equipment.

In one embodiment, the user can control the play of music and the control of other devices simply by moving the instrument in space. For example, raising the instrument upward, or increasing the pitch angle of the instrument from the horizontal, will be sensed by at least an accelerometer in the device 104. The signal from the accelerometer can be received and optionally processed by the device 104, with a digital control signal being generated and transmitted by the controller device 104 to a computer 502A for subsequent processing or to a hardware device 504 directly. Upon receipt of the accelerator data signal from the controller device 104, the control software of the computer 502A-502C or hardware device 504 recognizes the upward movement of the instrument and sends a control message signal accordingly to another hardware device for subsequent control of an equipment hardware function. For example, the volume of the sound can be increased as a direct, real time result of the user raising the instrument. Alternately, the brightness of the lighting in a musical stage environment could be increased. Similarly, as the accelerometer detects and downward change in the orientation of the instrument, the sound or lights could be reduced.

The sensors can detect other movements in the x, y, z three-dimensional plane of the instrument to which the controller device is attached and can generate signals from the device 104 to computers 502A-502C or other control hardware equipment 504 to control other effects. For example, the user can spin one revolution; and the resulting sensor data signals from the device can be interpreted to instruct the computer 502A-502C or hardware controller 504 to initiate special effects. Even lifting the instrument horizontally can be detected by the sensors to trigger generation of output control signals from the controller device 104. Such special effects can be a particular light show, or smoke, or even the playback of other instruments or recordings. In this manner, a sole use of a musical instrument can control multiple effects, play of music, and play of other instruments without ever removing his or her hands from the instrument.

When the user no longer needs digital controls on their instrument 100 he or she can simply slip the device 104 off and go back to playing the instrument 100 without any modifications.

While various embodiments have been described above, it should be understood that they have been presented by way of example only, and not limitation. Thus, the breadth and scope of the present disclosure should not limited by any of the above-described exemplary embodiments. Moreover, any combination of the above-described elements in all possible variations thereof is encompassed by the disclosure unless otherwise indicated herein or otherwise clearly contradicted by context.

Additionally, while the processes described above are shown as a sequence of steps, this was done solely for the sake of illustration. Accordingly, it is contemplated that some steps may be added, some steps may be omitted, the order of the steps may be re-arranged, and some steps may be performed in parallel.

What is claimed is:

1. A detachable device for control of a musical instrument, comprising:

a housing attached to a musical instrument, the housing providing for a set of controls and circuitry, wherein the housing is attached without modifying the musical instrument and wherein the housing is attached without compromising the operation of the musical instrument;

wherein the housing conforms to the shape of the musical instrument;

one or more user-operated controls contained in the housing, wherein the controls modify the play of music from the musical instrument;

one or more sensors detecting orientation of the musical instrument;

one or more sensors detecting movement of the musical instrument; and a clamp attaching the housing to the musical instrument, wherein the device can be detached from the musical instrument.

2. The device according to claim 1, wherein the play of music is controlled based on the orientation of the instrument.

3. The device according to claim 1, wherein the play of music is controlled based on the movement of the instrument.

4. The device according to claim 1, wherein the housing is attached without modification of the musical instrument.

5. The device according to claim 1, wherein the housing can be removed from the musical instrument without tools.

6. A method for controlling play of sound, comprising:

holding and playing a musical instrument by a user, wherein a controller device is removably attached to the musical instrument; and wherein the controller device includes a housing that conforms to the shape of the musical instrument;

generating audio output signals from the instrument as the user is playing the instrument;

manipulating controls on the controller device;

generating, by the controller device, output control signals based on the user manipulation of the controls on the controller device;

generating, by the controller device, output control signals based on the movement and orientation of the musical instrument; and controlling the play of sound from the musical instrument based on the generated output control signals.

7. The method according to claim 6, wherein the output control signals are generated based on a detected change in the orientation of the musical instrument.

8. The method according to claim 6, wherein the output control signals are generated based on a detected change in the movement of the musical instrument.

9. The method according to claim 6, wherein the output control signals control one or more of lighting, sound, playback, special effects, sound recording, and display.

10. A musical instrument control system, comprising:

a detachable controller attached to a musical instrument;

wherein the detachable controller includes a housing that conforms to the shape of the musical instrument;

one or more controls located on the detachable controller transmitting digital control signals upon manipulation by a user of the musical instrument;

one or more sensors transmitting digital control signals based on orientation of the musical instrument;

one or more sensors transmitting digital control signals based on movement of the musical instrument;

a computer receiving the transmitted digital control signals and processing the control signals into control messages; and equipment hardware receiving the control messages and controlling an equipment hardware function based on the control messages.

11. The system according to claim 10, wherein the controller comprises the function of one or more of a wireless peripheral device, an effects processor, an effects modulation device, a pre-amplifier, and an amplifier.

12. The system according to claim 10, wherein the controller transmits both digital control signals and audio signals.

13. The system according to claim 12, wherein signals are transmitted wirelessly.

14. The system according to claim 10, wherein the equipment hardware function comprises one or more of lighting control, sound control, special effects control, sound recording control, and display control.

15. The system according to claim 10, wherein the detachable controller can be attached to the musical instrument without modifying the instrument and is removable from the musical instrument without tools.

* * * * *